United States Patent [19]

Nelder

[11] 4,399,935

[45] Aug. 23, 1983

[54] CARTON CONSTRUCTION AND METHOD OF MAKING A CUTTING EDGE THEREFOR

[76] Inventor: Barbara L. Nelder, 5455 Catterick Rd., Richmond, Va. 23234

[21] Appl. No.: 233,406

[22] Filed: Feb. 11, 1981

[51] Int. Cl.[3] ..... B26D 1/02; B65D 85/671

[52] U.S. Cl. ..... 225/49; 225/91; 493/61; 493/86; 493/148

[58] Field of Search ..... 225/48, 49, 50, 91; 493/86, 148, 59, 61

[56] References Cited

U.S. PATENT DOCUMENTS

| | | | |
|---|---|---|---|
| 2,189,533 | 2/1940 | Harvey . | |
| 2,334,997 | 11/1943 | Doll . | |
| 2,336,842 | 12/1943 | Broeren et al. . | |
| 2,628,179 | 2/1953 | Bergstein . | |
| 2,766,877 | 10/1956 | Burbank | 225/91 X |
| 2,771,185 | 11/1956 | Annen | 225/91 X |
| 2,771,186 | 11/1956 | Burbank | 225/91 X |
| 3,169,685 | 2/1965 | Reilly . | |
| 3,193,427 | 7/1965 | Rogers . | |
| 3,229,875 | 1/1966 | Stoller . | |
| 3,547,328 | 12/1970 | Bjorklund | 225/49 |
| 3,722,767 | 3/1973 | Struble . | |
| 3,942,417 | 3/1976 | Finn . | |
| 3,974,947 | 8/1976 | Budny . | |
| 4,005,809 | 2/1977 | Finn . | |
| 4,340,162 | 7/1982 | Heiman et al. | 225/49 |
| 4,346,830 | 8/1982 | Hauser | 225/49 |

*Primary Examiner*—Frank T. Yost

*Attorney, Agent, or Firm*—Richard P. Matthews

[57] ABSTRACT

A carton construction and method of making an integral cutting edge therefor. An intermittent cut-score line is utilized at the juncture of the front and bottom main panels the cut segments of which extend into the front panel to provide a plurality of discrete teeth for the cutting edge. The end portions of each cut segment terminate approximately at the juncture of the front and bottom panels so that the space between the cut segments provide an axis for folding between the front and bottom panels in erecting the carton. Additionally, the individual teeth are stiffened by applying a coating thereto. The carton blank is formed into an open ended tube and a plurality of these tubes, in flattened condition, are stacked with the cutting teeth uppermost in which position they are coated, such as by a roller coating.

5 Claims, 10 Drawing Figures

CARTON CONSTRUCTION AND METHOD OF MAKING A CUTTING EDGE THEREFOR

This invention relates to a carton construction for dispensing foil, paper and film materials and, more particularly, to such a carton having an integral cutting edge and to a method of producing it.

BACKGROUND OF THE INVENTION

Heretofore, it has been the practice to dispense aluminum foil, waxed paper, plastic and other film materials from a paperboard carton having a metal cutting blade attached thereto most customarily at the inside top of the front main panel. While this arrangement dispenses the product adequately it has a number of disadvantages. One disadvantage is the added cost of purchasing the metal cutting blade and the need to attach it to the carton. Other disadvantages include the many complaints that are received by the seller and/or manufacturer concerning the cut fingers received by the consumer by inadvertent contact with the metal cutting edge in dispensing the product.

Some attempts have been made to use the paperboard material itself as a cutting edge but these attempts to date have been generally unsatisfactory either because of weakness of the paperboard resulting in too much flexure, the placement of the cutting edge on an unsupported edge of the carton, or in the use of extra paperboard material in the paperboard blank itself. Previous attempts to stiffen the paperboard such as with resin materials to provide a cutting edge have helped somewhat but have not fully cured the deficiency.

SUMMARY OF THE INVENTION

In accordance with the present invention the aforementioned disadvantages and shortcomings of the known prior art have been effectively overcome by the present invention. In particular, the cutting edge itself is obtained from the paperboard blank itself thereby eliminating the cost and installation of the metal cutting edge. The cutting edge is derived from the carton blank without adding extra panels or flaps. Furthermore, the cutting edge is positioned between the front and bottom panels which lends substantially more rigidity than when it is placed at the top of the front panel. This, of course, is not a problem when a metal cutting blade is used because of the rigidity provided by the blade and because of the sharpness and cutting efficiency of the metal cutting edge.

The present invention includes the provision of stiffening the cutting teeth by the application of a coating, grit, resin or other stiffening agent and includes a novel method of applying this coating or other stiffening agent.

In order to produce the integral cutting edge, an intermittent cut-score line is used at the joinder of the front and bottom main panels with the cut segments thereof extending into the front panel thereby providing individual teeth upon erecting the carton. Of course, this intermittent cut-score line could be made between other main panels but the dispensing would not be so convenient as the preferred location.

Since the cut-score line is so positioned and arranged that the end portions of every cut segment ends approximately where the normal fold line between the top and bottom panels would occur, the space between the cut segments serves as an axis between the top and bottom main panels when the carton is erected.

The method by which the teeth are stiffened by applying a coating thereto is believed to be unique. The carton blank having conventional fold lines between all the main panels except between the top and bottom main panels which has the previously described intermittent cut-score line, is first formed conventionally into an open ended tube in flattened condition. These flattened tubes are then stacked closely adjacent each other with the cutting teeth on top in which position they are coated, such as by a roller coating.

DESCRIPTION OF THE DRAWINGS

The inherent advantages and improvements of the present invention will become more readily apparent upon reference to the subsequent detailed description of the invention and by reference to the drawings wherein.

DETAILED DESCRIPTION OF THE INVENTION

Figure 1:
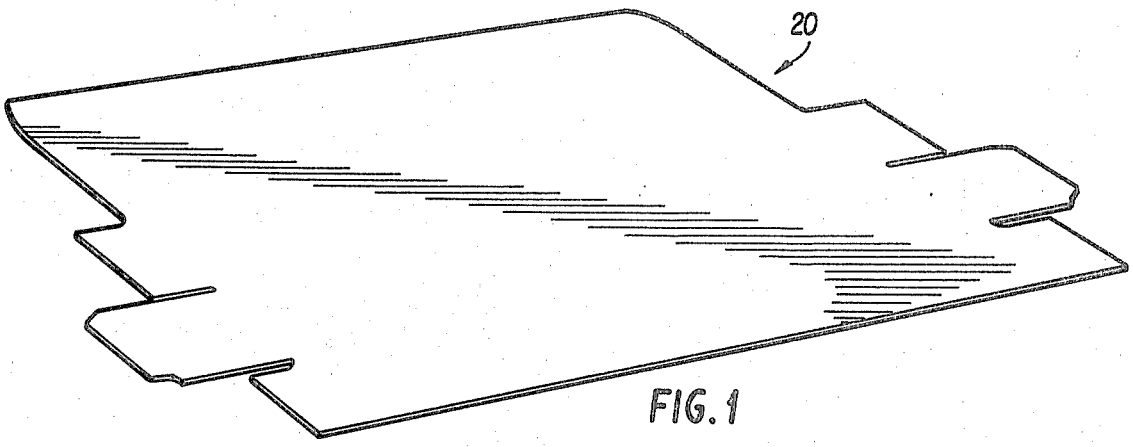
FIG. 1 is a perspective view of a typical blank suitable for the practice of the present invention.
Figure 2:
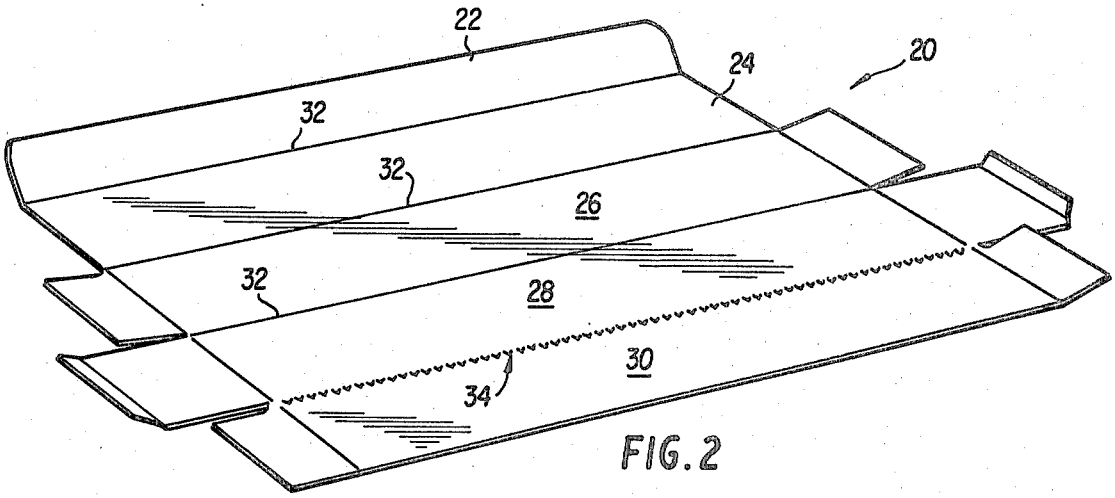
FIG. 2 is a perspective view of the blank of FIG. 1 prior to being erected.

Referring now to FIG. 1 of the drawings, a carton blank is indicated generally at 20. The same carton blank is illustrated in FIG. 2 after the blank has been prepared for erection into a finished carton. The blank in FIG. 2 is shown to comprise a glue flap panel 22, top main panel 24, back main panel 26, bottom main panel 28, and front main panel 30. Thus, all main panels and the glue flap panel 22 are separated from the adjacent main panel by score lines 32 with the exception of the juncture between bottom main panel 28 and front panel 30. In that position, an intermittent cut-score line indicated generally at 34 is provided and which will be discussed in greater detail hereinafter.

The end closure flaps illustrated in FIGS. 1 and 2 and the manner in which they close the ends of the carton are immaterial with respect to the present invention and any suitable end carton flaps may be employed in the practice of the present invention.

Figure 9:
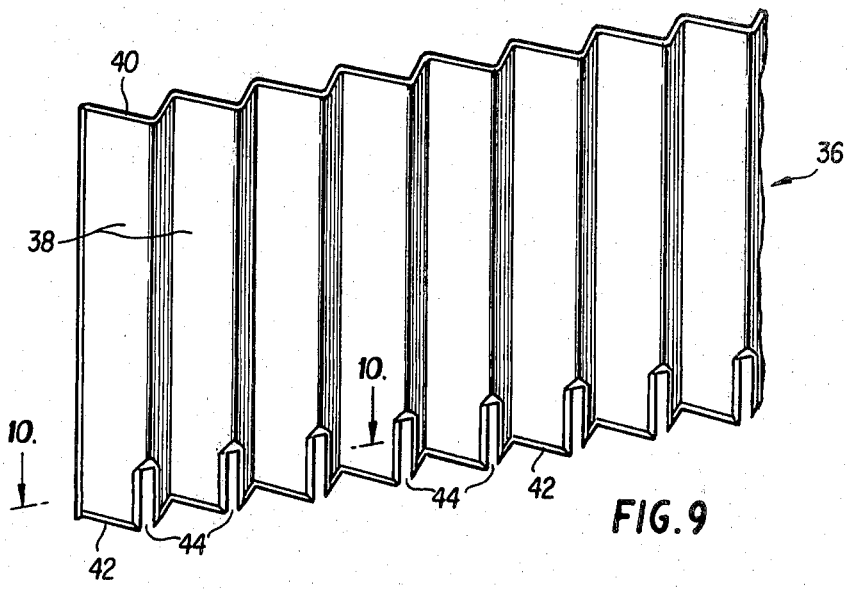
FIG. 9 is a fragmentary perspective view of a knife suitable for imparting an intermittent cut-score line to the blank.
Figure 10:
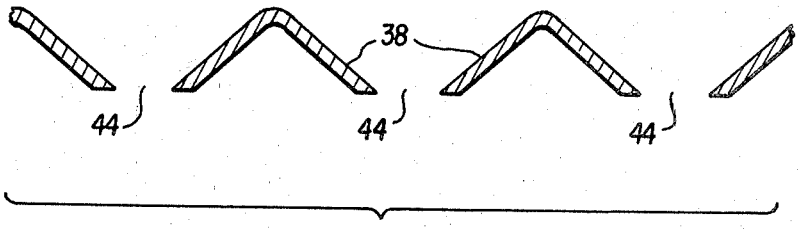
FIG. 10 is a fragmentary plan view, taken in horizontal cross section along line 10—10 of FIG. 9 and drawn to an enlarged scale.

For purposes of describing a satisfactory manner in which the intermittent cut-score line 34 is provided, reference is made to a suitable cut-score tool indicated generally at 36 in FIG. 9. This figure illustrates a plurality of V-shaped corrugations 58 on a metal tool which may be mounted for inclusion in a die for vertical reciprocation and for actuation substantially simultaneously with the conventional tools used to provide the score lines 32 of FIG. 2. Tool 36 is shown to have a non-cutting top edge 40 and bottom cutting edges 42 which provide discrete or intermittent cut segments by virtue of the provision of the plurality of relieved areas 44 which extend upwardly from the plane of cutting edges 42 into the metal tool a sufficient distance to prevent any cutting of the blank in the course of its reciprocation into or through the carton blank 20.

For purposes of this application, the term "cut-score" is used to distinguish from a score line which does not break the surface of the carton blank. A "cut-score" does break the surface of the carton blank but it need not necessarily go all the way through.

Figure 3:
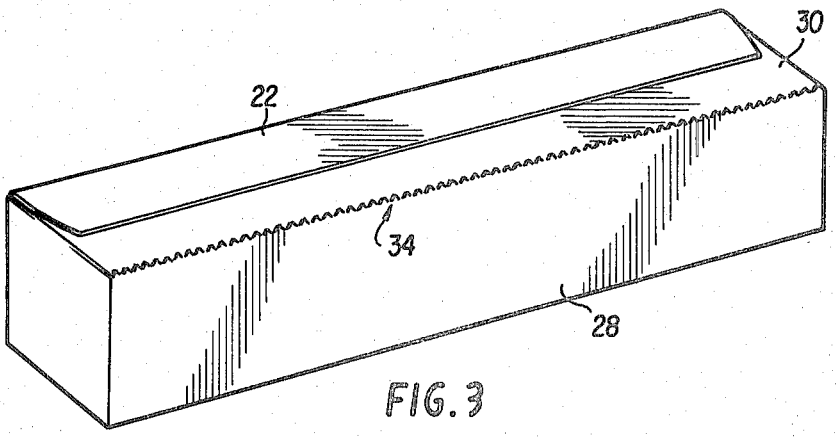
FIG. 3 is a perspective view of the blank of FIG. 1 after being erected and filled with a product.
Figure 4:
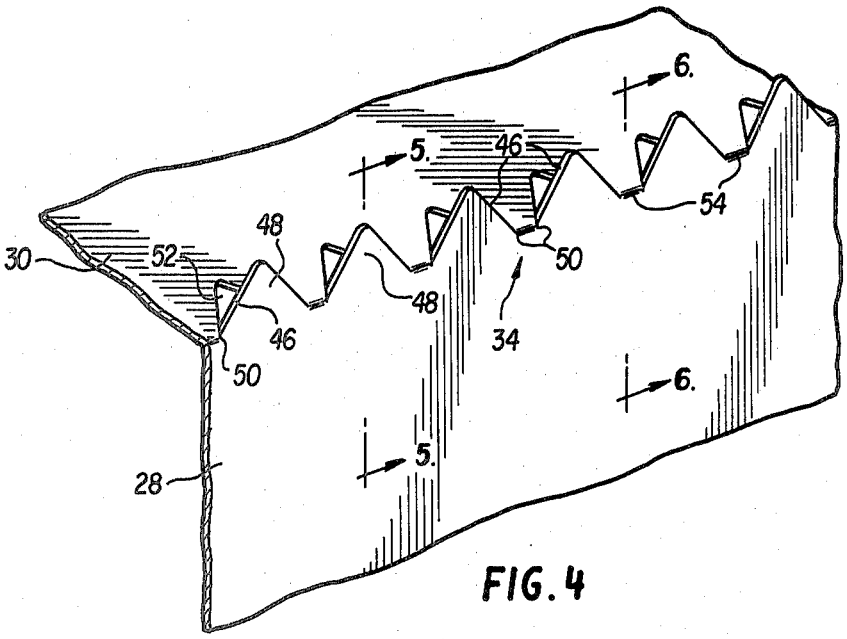
FIG. 4 is a fragmentary perspective view, drawn to an enlarged scale, illustrating the emergence of the cutting teeth from the front panel.
Figure 5:
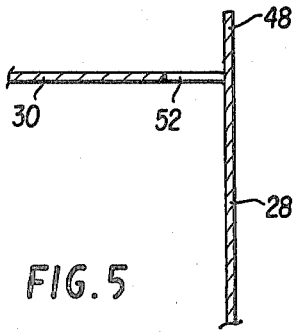
FIG. 5 is a fragmentary elevational view taken in vertical cross section along line 5—5 of FIG. 4.
Figure 6:
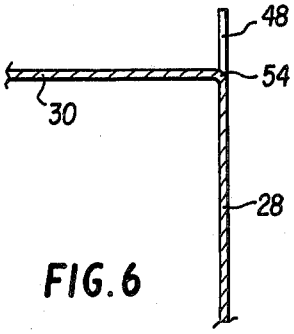
FIG. 6 is a fragmentary elevational view taken in vertical cross section along line 6—6 of FIG. 4.
Figure 7:
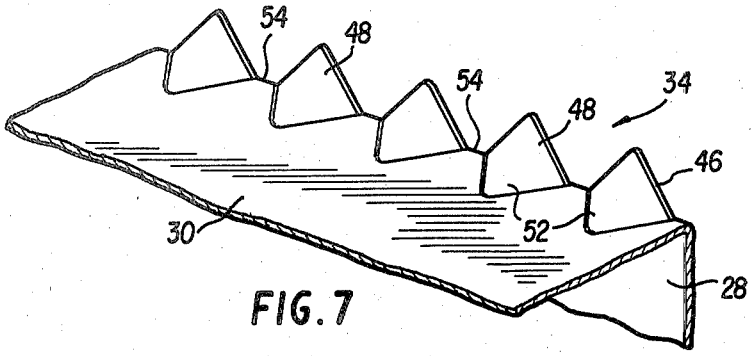
FIG. 7 is a fragmentary perspective view showing the cutting teeth as seen from the top of the front panel.

Referring now to FIGS. 4 through 7, there is illustrated in fragmentary views the intermittent cut-score line 34 as is provided between the juncture of front panel 30 and bottom panel 28. The tooth edge or profile is shown at 46 for an individual tooth 48. The ends of tooth edges or profiles 46 is at 50 which constitutes the ends of the cut segments and which lies substantially at the juncture of the front panel 30 and bottom panel 28. The material removed from the front panel to form an individual tooth 48 is designated 52 and the space 54 between the ends 50 collectively define an axis for folding between the front panel 30 and bottom panel 28 in the course of the erection of the carton blank to achieve the fully erected position shown in FIG. 3.

Figure 8:
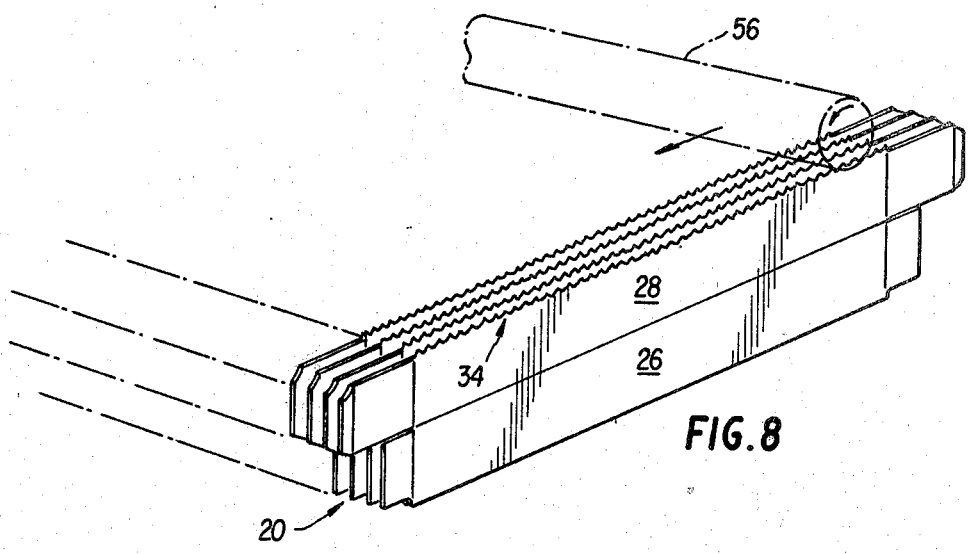
FIG. 8 is a fragmentary perspective view illustrating the method of coating the cutting teeth.

It is desired to provide a stiffening coating to the individual teeth 48 to prolong their useful life and to ensure satisfactory cutting of strip material. The method by which this coating of the teeth is carried out is to form the carton blank into an open ended tube by adhesively securing the glue flap 22 to the front of the front panel 30 in conventional manner. The cartons are then stacked as is illustrated in FIG. 8 by standing a plurality of the open-ended tubes in their flattened condition, positioned closely adjacent each other and with each of the integral cutting edges provided by the intermittent cut-score line 34 uppermost as is seen in FIG. 8. The blanks are held in this position by any suitable means and the upstanding cutting edges are then coated, such as by a roller coater 56, which moves in the direction of the arrows and imparts a stiffening coating in the form of a plastic material or grit material to the upstanding teeth.

A number of modifications may be made in the practice of the present invention. For example, the location of the cutting edge provided by the intermittent cut-score line 34 could be between other main panels than the bottom and front panels. However, it is not desirable to have the cutting edge at the top of the front panel because in this position the cutting edge is lacking in rigidity. One additional advantage of utilizing the cutting edge between the front and bottom panels is that in dispensing discrete portions from strip material, there will always be a starter or tail portion of the strip product ready to be grasped. As has been noted, the end closure flaps can take any desired form in the practice of the present invention. The profile of the teeth may also be varied and need not be V-shaped as is illustrated. Thus, they may be round or flattened at the apex of the teeth. It is necessary only that they extend into the panel from which the tooth is cut. Also, the kinds of coatings and applicators may differ widely and still come within the purview of the present invention.

While a presently preferred embodiment of the invention has been illustrated and described, it will be recognized that the invention may be otherwise variously embodied and practiced within the score of the claims which follow.

What is claimed is:

1. A method of making a carton with an integral cutting edge located between the front and bottom panels of the carton which comprises the steps of a. scoring a flat carton blank in a plurality of positions to provide a fold score line between adjacent longitudinally extending main panels of said blank except between the front and bottom panels, b. forming a series of individual, closely-spaced teeth by cut-scoring partially through the front panel of said carton at the juncture of the front and bottom panels,

1. each tooth formed by a cut-score being generally V-shaped with the free terminal leg portions thereof located at the juncture of said front and bottom panels and forming a fold axis therebetween, c. and, thereafter, folding the carton blank along the score lines and the fold axis between the front and bottom panels to erect the carton.

2. A method of making a carton with an integral cutting edge as defined in claim 1 including the additional step of stiffening the teeth to prolong the useful life of the cutting edge provided by said teeth when said carton is erected.

3. A method of making a carton with an integral cutting edge as defined in claim 2 including the additional steps of a. forming said carton blank into an open ended tube by adhesively securing a glue flap to said front panel, b. standing a plurality of said open ended tubes in flattened condition positioned closely adjacent each other and each with their integral cutting edges uppermost, c. and coating the upstanding cutting edges.

4. A method of making a carton with an integral cutting edge as defined in claim 3 including the additional step of using a roller to coat the upstanding cutting edges.

5. In a paperboard carton construction of the type having front, back, top and bottom main panels and an adhesive flap pivotally secured to said top main panel and adhesively secured to said front main panel the improvement which comprises:

a. a cutting edge formed integrally with the carton blank and positioned at the juncture of the front and bottom panels, said cutting edge being formed from a series of individual, closely-spaced teeth each of which is formed from a cut-score that penetrates only partially through the blank, each of said teeth being generally V-shaped with the free terminal leg portions thereof lying along a fold axis established upon erecting the carton and located between said front and bottom main panels.

* * * * *